United States Patent [19]

Sakamoto

[11] Patent Number: 4,645,436

[45] Date of Patent: Feb. 24, 1987

[54] SCROLL TYPE FLUID DISPLACEMENT APPARATUS WITH IMPROVED ANTI-WEAR DEVICE

[75] Inventor: Seiichi Sakamoto, Gunma, Japan

[73] Assignee: Sanden Corporation, Gunma, Japan

[21] Appl. No.: 878,529

[22] Filed: Jun. 20, 1986

Related U.S. Application Data

[63] Continuation of Ser. No. 697,746, Feb. 4, 1985, abandoned.

[51] Int. Cl.[4] ..... F04C 18/04; F04C 27/00; F04C 29/04

[52] U.S. Cl. ..... 418/55; 418/83; 418/142; 418/178

[58] Field of Search ..... 418/55, 83, 142, 178

[56] References Cited

U.S. PATENT DOCUMENTS

| | | | |
|---|---|---|---|
| 612,695 | 10/1898 | Backman | 92/169 |
| 801,182 | 10/1905 | Creux | 418/55 |
| 1,557,720 | 10/1925 | Mueller | 92/169 |
| 1,914,499 | 6/1933 | Geisse | 92/169 |
| 3,994,635 | 11/1976 | McCullough | 418/55 |
| 4,487,560 | 12/1984 | Uchikawa et al. | 418/55 |
| 4,498,852 | 2/1985 | Hiraga | 418/55 |

FOREIGN PATENT DOCUMENTS

| | | | |
|---|---|---|---|
| 12615 | 6/1980 | European Pat. Off. | 418/55 |
| 55-35155 | 3/1980 | Japan | 418/55 |

*Primary Examiner*—John J. Vrablik

*Attorney, Agent, or Firm*—Banner, Birch, McKie & Beckett

[57] ABSTRACT

A scroll type fluid displacement apparatus is disclosed which includes a pair of scrolls each having a circular end plate and a spiral element extending from one end surface of the circular end plate. The pair of scrolls are maintained at an angular and radial offset so that both spiral elements interfit to form a plurality of line contacts between their spiral curved surfaces to thereby seal off and define at least one pair of fluid pockets. The fluid pockets are moved by relative orbital motion of the pair of scrolls. At least one of the circular end plates is provided with an anti-wear plate covering the end surface thereof in the area on which an axial end surface of the opposing spiral element slidably contacts. The circular end plate has a depressed portion at the center portion thereof to define an axial clearance between the anti-wear plate and the central portion of the end plate. Therefore, changes in the axial length of the spiral element due to temperature changes is absorbed by the deformation of the anti-wear plate into the depressed portion.

3 Claims, 6 Drawing Figures

SCROLL TYPE FLUID DISPLACEMENT APPARATUS WITH IMPROVED ANTI-WEAR DEVICE

This application is a continuation, of application Ser. No. 697,746, filed Feb. 4, 1985, abandoned.

BACKGROUND OF THE INVENTION

This invention relates to a scroll type fluid displacement apparatus, and more particularly, to an improved anti-wear device for the scrolls used in a scroll type fluid compressor.

Scroll type fluid displacement apparatus are well known in the prior art. For example, U.S. Pat. No. 801,182 issued to Creux discloses the basic construction of a scroll type fluid displacement apparatus including two scrolls each having a circular end plate and a spiroidal or involute spiral element. The scrolls are maintained at an angular and radial offset so that both spiral elements interfit to form a plurality of line contacts between their curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction of the orbital motion. Thus, a scroll type fluid displacement apparatus may be used to compress, expand or pump fluids.

In comparison with conventional compressors of the piston type, scroll type compressors have certain advantages, such as fewer parts and continuous compression of fluid. However, one of the problems with scroll type compressors is ineffective sealing of the fluid pockets. Axial and radial sealing of the fluid pockets must be maintained in a scroll type compressor in order to achieve efficient operation. The fluid pockets are defined by line contacts between the interfitting spiral elements and the axial contacts between the axial end surface of one spiral element and the inner end surface of the facing end plate.

Various techniques have been used in the prior art to solve the axial sealing problem. In U.S. Pat. No. 3,994,635, a seal element is mounted on the axial end surface of each spiral element and urged toward the end surface of the facing end plate by an urging device to effectuate sufficient axial sealing between the axial end surface of the spiral element and the end surface of the facing end plate. But, in the above '635 patent, because the seal element is urged toward the end surface of the facing end plate by an urging device, over a period of time, abrasions occur between the seal elements and the end plate of the scroll, especially when lightweight alloys such as aluminum alloys are used as the scroll material. When the end plate wears due to abrasion, the seal elements also are damaged, and the axial contact between the end surface of the spiral element and the inner end surface of the end plate becomes imperfect, which reduces compressor efficiency.

One solution to the above disadvantages is disclosed in commonly assigned copending patent application Ser. No. 587,871, filed Mar. 14, 1984. The '871 patent application discloses an anti-wear device for the scrolls which includes an anti-wear plate disposed on an end surface of the end plate of at least one of the scrolls. The anti-wear plate faces the axial end surface of the spiral element of the other scroll to prevent wear and maintain axial sealing.

As shown in FIG. 1, which is a vertical cross-sectional view of an earlier version of a scroll type fluid compressor, anti-wear plates 41' are disposed on an axial end surface of each end plate 271', 281'. Shims 113' are provided to establish a predetermined axial clearance between the axial end surface of each spiral element and the opposing anti-wear plate. Shims 113' are disposed between front end plate 11' and cup-shaped casing 12'. Even though the shim thickness is properly selected in the initial state, the axial clearance between the axial end surface of each seal element and the opposing anti-wear plate may change due to bending of each end plate in response to pressure changes. Also, once the thrust race and thrust balls of the rotation prevention/thrust bearing device settle due to a continuous compression gas load, the tight seal between the axial end surface of the seal element and the opposing anti-wear plate may be lost. Additionally, the spiral element, in particular, the central portion of the spiral element, expands in response to thermal changes in the compressed fluid causing further loss of sealing.

Though solutions exist for loss of axial sealing due to bending of the end plate and settling in the ball coupling type rotation prevention/thrust bearing device, no acceptable solution exists for changes in the axial length of the spiral element due to thermal changes. Thus, despite the existence of solutions to the other problems mentioned above, effective axial sealing between the seal element and the anti-wear plate can be easily lost.

Furthermore, it should be noted that, in scroll type fluid compressors, the interfitting spiral elements extend through several temperature zones. These different temperature zones are created because there are a plurality of pairs of sealed off fluid pockets between the interfitting spial elements, each of which has a different temperature and pressure. Because temperature and pressure at the central fluid pocket are the greatest, the central portion of each spiral element usually is the highest temperature and pressure area. Therefore, in order to achieve effective axial sealing in the central portion of the spiral elements, changes in axial clearance due to thermal changes must be minimized. However, to solve this thermal problem in the central portion of the spiral elements, if the initial axial clearance between the seal element and the anti-wear plate is set to a minimum, the central portions of the spiral elements strongly contact the opposing anti-wear plate resulting in abnormal wearing of the spiral elements and excessive force acting on the base portion of each spiral element.

SUMMARY OF THE INVENTION

It is a primary object of this invention to provide a scroll type fluid displacement apparatus which achieves sufficient axial sealing despite thermal changes in the spiral elements.

It is another object of this invention to provide a scroll type fluid displacement apparatus which prevents abnormal wear of and damage to the scrolls.

It is a further object of this invention to realize the above objects with a simple construction which can be simply manufactured at low cost.

A scroll type fluid displacement apparatus according to this invention includes a pair of scrolls, each comprising an end plate and a spiral wrap extending from one side surface of the end plate. The spiral wraps interfit at an angular and radial offset to make a plurality of line contacts to define at least one pair of sealed off fluid pockets. A driving mechanism is operatively connected to one of the scrolls to effect the orbital motion of the one scroll relative to the other scroll while simultaneously preventing rotation of the one scroll. At least one involute plate is disposed between an axial end surface of one spiral element and the inner end surface of the opposing end plate. The involute plate covers only the area of the surface of the end plate of the scroll where the spiral wrap makes axial contact during the orbital motion of the one scroll to thereby prevent excessive wear and abrasion. An indentation or depressed portion is formed on the end surface of the end plate on which the involute plate is disposed. This indentation or depressed portion is located near the central portion of the end plate to define an axial air gap between the involute plate and the central portion of the end surface of the end plate to permit thermal expansion in the central portion without loss of axial sealing caused by wear and abrasion.

Further objects, features and other aspects of this invention will be understood from the following detailed description of the preferred embodiment of this invention, referring to the annexed drawings.

DETAILED DESCRIPTION OF THE PREFERRED EMBODIMENT

Figure 1:
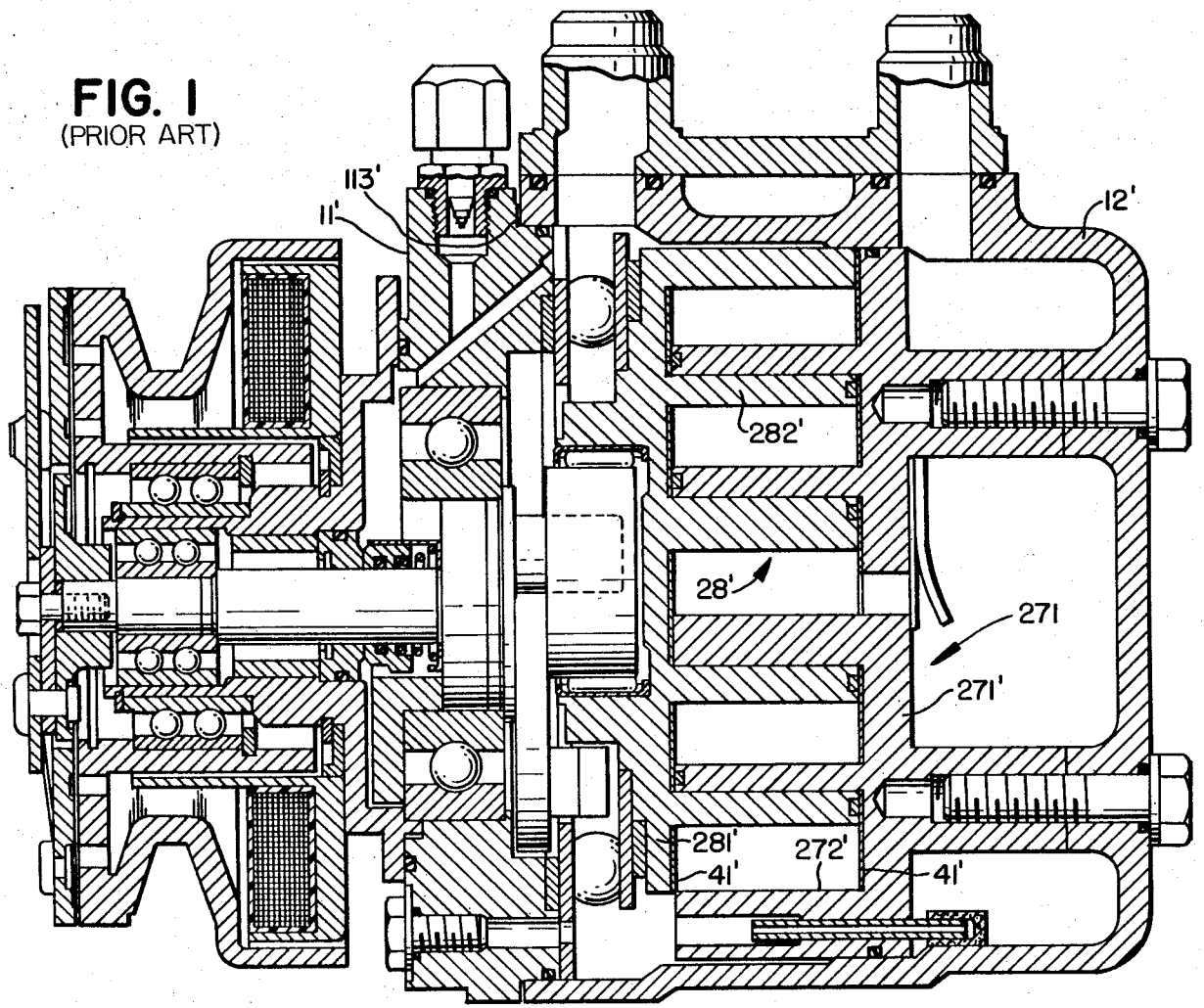
FIG. 1 (PRIOR ART)
FIG. 1 is a vertical sectional view of an earlier version of a scroll type fluid compressor.
Figure 2:
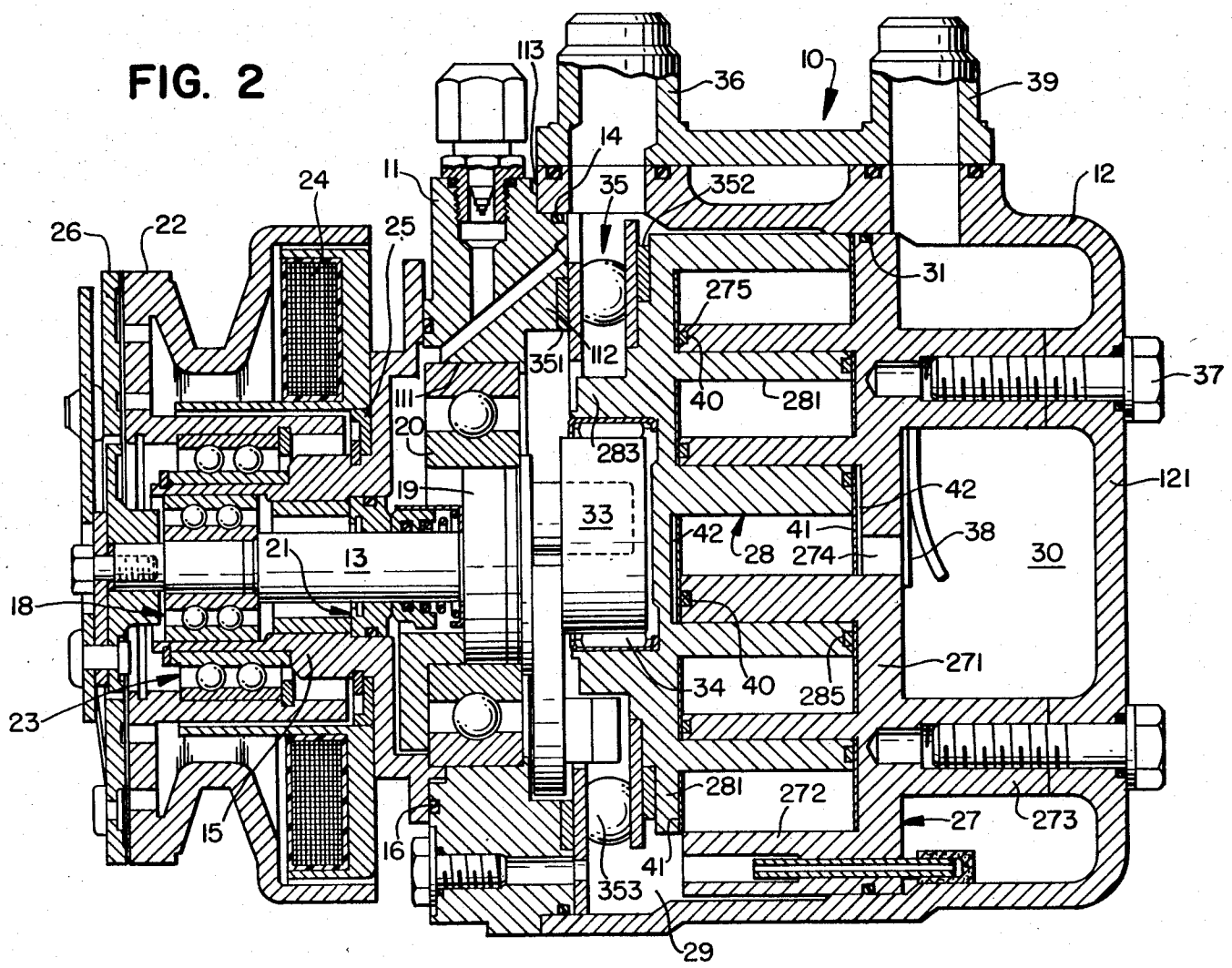
FIG. 2 is a vertical sectional view of a scroll type fluid compressor in accordance with an embodiment of this invention.

Referring to FIG. 2, scroll type refrigerant compressor 1 includes compressor housing 10 having a front end plate 11 mounted on cup-shaped casing 12. Opening 111 is formed in the center of front end plate 11 for penetration or passage of drive shaft 13. Annular projection 112 is formed in a rear end surface of front end plate 11. Annular projection 112 faces cup-shaped casing 12 and is concentric with opening 111. An outer peripheral surface of annular projection 112 extends into an inner wall of the opening of cup-shaped casing 12 so that the opening of cup-shaped casing 12 is covered by front end plate 11. O-ring 14 is placed between the outer peripheral surface of annular projection 112 and the inner wall of the opening of cup-shaped casing 12 to seal the mating surfaces of front end plate 11 and cup-shaped casing 12.

Annular sleeve 15 projects from the front end surface of front end plate 11 to surround drive shaft 13; annular sleeve 15 defines a shaft seal cavity. In the embodiment shown in FIG. 2, sleeve 15 is formed separately from front end plate 11. Therefore, sleeve 15 is fixed to the front end surface of front end plate 11 by screws (not shown). O-ring 16 is placed between the end surface of sleeve 15 and the front end plate 11 and sleeve 15. Alternatively, sleeve 15 may be formed integral with end plate 11.

Drive shaft 13 is rotatably supported by sleeve 15 through bearing 18 located within the front end of sleeve 15. Drive shaft 13 has disk 19 at its inner end; disk 19 is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23 which is carried on the outer surface of sleeve 15. Electromagnetic coil 24 is fixed about the outer surface of sleeve 15 by support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of an automobile, through a rotation transmitting device such as the above-explained magnetic clutch.

A number of elements are located within the inner chamber of cup-shaped casing 12 including fixed scroll 27, orbiting scroll 28, a driving mechanism for orbiting scroll 28 and rotation preventing/thrust bearing device 35 for orbiting scroll 28. The inner chamber of cup-shaped casing 12 is formed between the inner wall of cup-shaped casing 12 and the rear end surface of front end plate 11.

Fixed scroll 27 includes circular end plate 271, wrap or spiral element 272 affixed to or extending from one end surface of end plate 271 and internal threaded bosses 273 axially projecting from the other end surface of end plate 271. An axial end surface of each boss 273 is sealed on the inner end surface of bottom plate portion 121 of cup-shaped casing 12 and fixed by screws 37 screwed into bosses 273 from the outside of bottom plate portion 121. Thus, fixed scroll 27 is fixed within the inner chamber of cup-shaped casing 12. Circular end plate 271 of fixed scroll 27 partitions the inner chamber of cup-shaped casing 12 into front chamber 29 and rear chamber 30. Seal ring 31 is disposed within a circumferential groove of circular end plate 271 to form a seal between the inner wall of cup-shaped casing 12 and the outer surface of circular end plate 271. Spiral element 272 of fixed scroll 27 is located within front chamber 29.

Cup-shaped casing 12 is provided with a fluid inlet port 36 and fluid outlet port 39, which are connected to rear and front chambers 29 and 30, respectively. A hole or discharge port 274 is formed through circular end plate 271 at a position near the center of spiral element 272. A reed valve 38 closes discharge port 274.

Orbiting scroll 28, which is located in front chamber 29, includes circular end plate 281 and wrap or spiral element 282 affixed to or extending from one end surface of circular end plate 281. Spiral elements 272 and 282 interfit at an angular offset of 180° and at a predetermined radial offset. Spiral elements 272 and 282 define at least one pair of sealed off fluid pockets between their interfitting surfaces. Orbiting scroll 28 is rotatably supported by bushing 33 through bearing 34 placed between the outer peripheral surface of bushing 33 and the inner surface of annular boss 283 axially projecting from the end surface of circular end plate 281 of orbiting scroll 28. Bushing 33 is connected to an inner end of disk 19 at a point radially offset or eccentric of the axis of drive shaft 13.

Rotation preventing/thrust bearing device 35 is disposed around the outer peripheral surface of boss 282 and placed between the inner end surface of front end plate 11 and the end surface of circular end plate 281 which faces the inner end surface of front end plate 11.

Rotation preventing/thrust bearing device 35 includes fixed ring 351 attached to the inner end surface of front end plate 11, orbiting ring 352 attached to the end surface of circular end plate 281, and a plurality of bearing elements, such as balls 353, placed between the pockets formed by rings 351 and 352. Rotation of orbiting scroll 28 during orbital motion is prevented by the interaction of balls 353 with rings 351, 352. The axial thrust load from orbiting scroll 28 also is supported on front end plate 11 through balls 353.

In the above arrangement of scroll type refrigerant compressor 1, fluid from the external fluid circuit is introduced into fluid pockets in the compressor unit through inlet port 36. The fluid pockets comprise open spaces formed between spiral elements 272 and 282. As orbiting scroll 282 orbits, the fluid in the fluid pockets moves to the center of the spiral elements and is compressed. The compressed fluid from the fluid pockets is discharged into rear chamber 30 from the fluid pockets through discharge hole 274. The compressed fluid then is discharged to the external fluid circuit through outlet port 39.

Figure 3A:
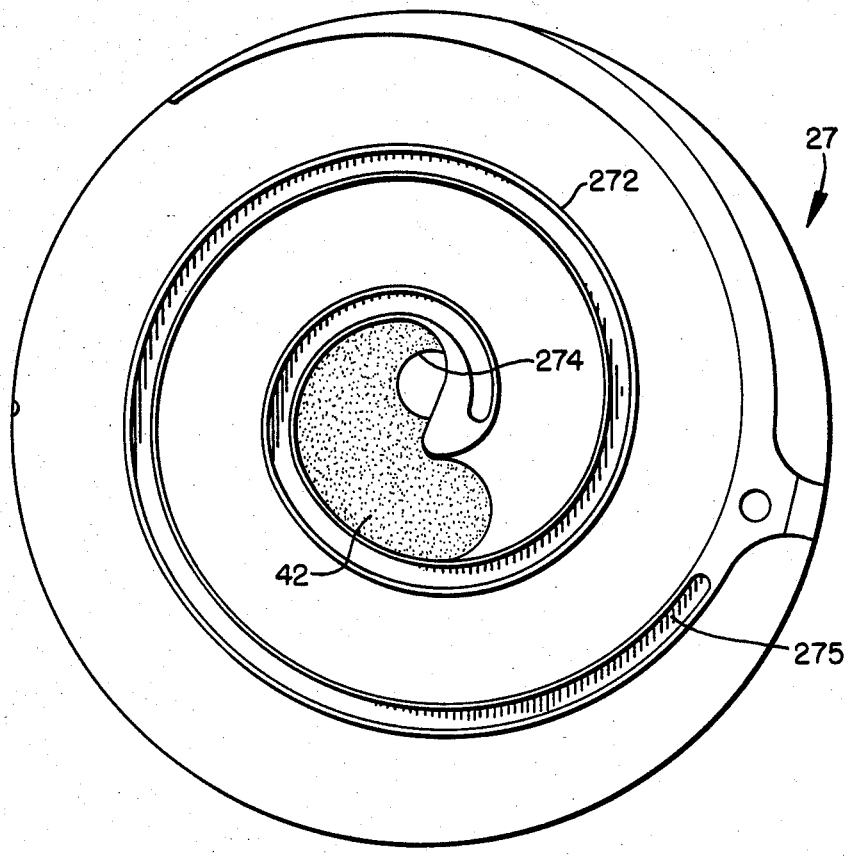
FIG. 3(*a*) is a front view of the fixed scroll used in FIG. 2 and FIG. 3(*b*) is a vertical sectional view of the fixed scroll in FIG. 3(*a*).
Figure 3B:
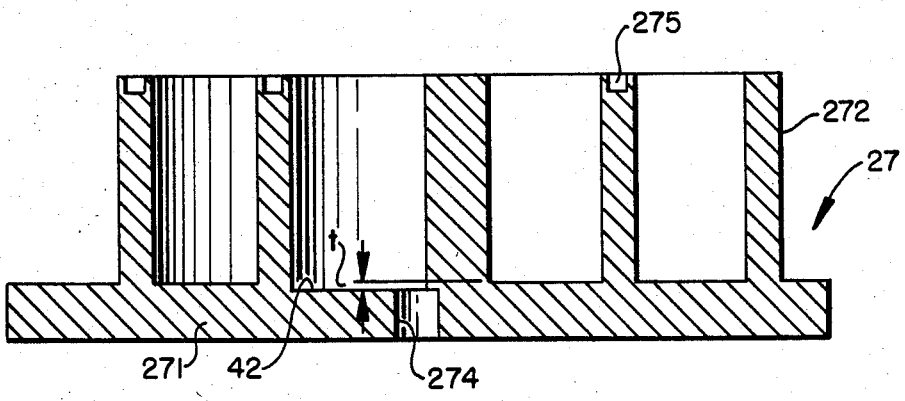

As shown in FIGS. 2 and 3, spiral elements 272, 282 include grooves 275, 285 on the axial end surface thereof. Seal element 40 is disposed in the grooves to provide a seal between the end surface of each circular end plate 271, 281 and the axial end surface of each seal element 40. Involute plate 41, which is formed of hard metal, such as hardened steel, is fitted to the end surface of both circular end plates 271, 281 to minimize the abrasion and reduce wear of the scrolls. The central portion of each circular end plate 271, 281 has an indentation or depressed portion 42 as shown by the dotted area in FIG. 3(*a*). This depressed portion 42 extends from the center portion of circular end plate 271 to a position along the spiral curved surface. Depressed portion 42 could be formed by machine tooling, such as end milling, and depth "t" is easily defined by the forming process.

Figure 4A:
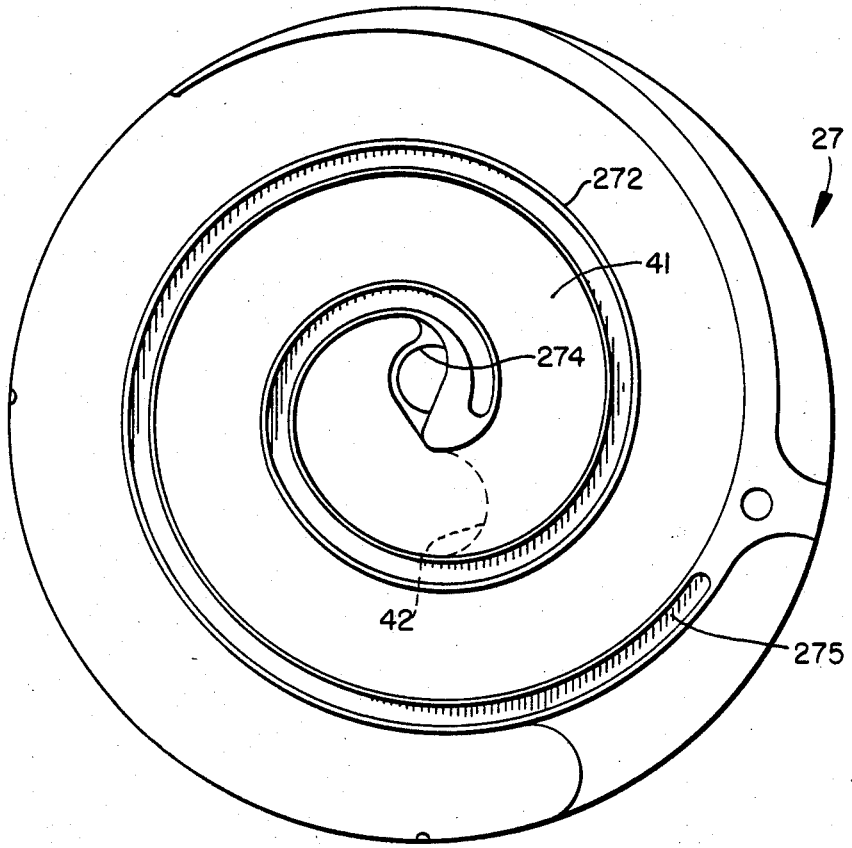
FIG. 4(*a*) is a front view of a fixed scroll with an involute plate and FIG. 4(*b*) is a vertical sectional view of the fixed scroll in FIG. 4(*a*).
Figure 4B:
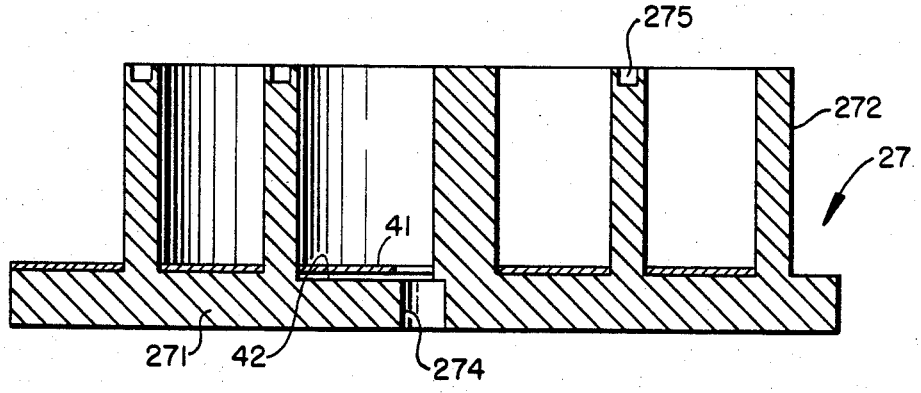

When involute plate 41 is fitted on circular end plate 271 to cover the portion of the end surface on which the axial end surface of seal element 40 slides during orbital motion of orbiting scroll 28 as shown in FIG. 4(*a*), an axial air gap is defined between the inner end surface of involute plate 41 and the bottom surface of depressed portion 42 as best shown in FIG. 4(*b*). Therefore, changes in the axial length of spiral element 282, which are caused by thermal changes in the central portion of the spiral elements, is absorbed by deformation of involute plate 41. The deformation of involute plate 41, such as bending deformation, occurs within the axial air gap defined between the depressed portion and the involute plate. The depth "t" of depressed portion 42 should correspond to the maximum expansion of the spiral element in order to absorb changes in the axial length of the spiral element. During the operation of the scroll type refrigerant compressor, reaction forces caused by the above deformation which act upon the facing spiral element are so small that the force transmitted to the base portion of the spiral element is reduced. Also, the axial air gap between the inner end surface of involute plate 41 and the bottom surface of depressed portion 42 could be filled by lubricating oil because depth "t" has such a small dimension. This would prevent any blow-by phenomena from occurring in the area of depressed portion 42.

Finally, it is noted that, as shown in FIG. 2, involute plate 41 can be disposed on the end surfaces of both end plates 271 and 281. In this case, depressed portion 42 is formed on both end plates 271, 281. However, involute plate 41 can be disposed on either of the end plates as long as the depressed portion is formed on the end plate on which the involute plate is disposed.

The present invention has been described in detail in connection with a preferred embodiment. This embodiment, however, is merely for example only and the invention is not restricted thereto. It will be understood by those skilled in the art that other variations and modifications can be made within the scope of this invention as defined in the appended claims.

I claim:

1. In a scroll type fluid displacement compressor including a pair of scrolls each having a circular end plate and a spiral wrap extending from an axial end surface of said circular end plate, said pair of scrolls being maintained at an angular and radial offset so that said spiral wraps interfit to form a plurality of line contacts between their spiral curved surfaces to thereby seal off and define at least one pair of fluid pockets, a driving mechanism operatively connected to one of said scrolls to effect relative orbital motion with respect to the other of said scrolls to thereby change the volume of the fluid pockets, and an involute plate disposed on an axial end surface of the circular end plate of both said scrolls to cover the area on which contact is made by an axial end surface of the opposing spiral wrap, the improvement comprising a depressed portion formed at the entire center high pressure portion only of said end plates of both said scrolls to increase volumetric efficiency by compensating for thermal expansion, said depressed portion and said involute plate defining an axial air gap between an inner end surface of said involute plate and a bottom surface of said depressed portion on both said scrolls.

2. The scroll type fluid displacement compressor of claim 1 wherein each of said spiral wraps is provided with a groove at an axial end surface thereof and a seal element is disposed in said groove.

3. In a scroll-type fluid displacment compressor including a housing having a fluid inlet port and fluid outlet port, a fixed scroll fixedly disposed within said housing and having a circular end plate from which a first spiral wrap extends, an orbiting scroll having a circular end plate from which a second spiral wrap extends, said first and second spiral wraps interfitting at an angular and radial offset to form a plurality of line contacts to define at least one pair of sealed off fluid pockets, a driving mechanism operatively connected to said orbiting scroll to effect the orbital motion of said orbiting scroll and a rotation preventing means for preventing the rotating motion of said orbiting scroll during the orbital motion of said orbiting scroll to thereby change the volume of the fluid pockets, the improvement comprising an involute plate disposed on both of said end plates of said fixed and orbiting scrolls to cover the area on which contact is made by an axial end surface of the opposing spiral wrap, and a depressed portion formed at the entire center high pressure portion only of said end plates of both said scrolls to increase volumetric efficiency by compensating for thermal expansion, said depressed portion and said involute plate defining an axial air gap between an inner end surface of said involute plate and the opposing surface of said end plate on both said scrolls.

* * * * *